US008958588B2

(12) United States Patent
Müller

(10) Patent No.: US 8,958,588 B2
(45) Date of Patent: Feb. 17, 2015

(54) HEARING AID AND DETECTION DEVICE

(71) Applicant: Bernafon AG, Berne (CH)

(72) Inventor: Christian Müller, Berne (CH)

(73) Assignee: Bernafon AG, Berne (CH)

( * ) Notice: Subject to any disclaimer, the term of this patent is extended or adjusted under 35 U.S.C. 154(b) by 22 days.

(21) Appl. No.: 13/795,517

(22) Filed: Mar. 12, 2013

(65) Prior Publication Data

US 2013/0243228 A1 Sep. 19, 2013

Related U.S. Application Data

(60) Provisional application No. 61/609,962, filed on Mar. 13, 2012.

(30) Foreign Application Priority Data

Mar. 13, 2012 (EP) ..... 12159221

(51) Int. Cl.
*H04R 25/00* (2006.01)
*H04R 5/00* (2006.01)

(52) U.S. Cl.
CPC ..... *H04R 25/554* (2013.01); *H04R 25/558* (2013.01); *H04R 2225/51* (2013.01)
USPC ..... 381/315; 381/23.1

(58) Field of Classification Search
USPC ..... 381/312–321, 60, 23.1
See application file for complete search history.

(56) References Cited

U.S. PATENT DOCUMENTS

2004/0131213 A1* 7/2004 Niederdrank ..... 381/315

FOREIGN PATENT DOCUMENTS

| | | | |
|---|---|---|---|
| EP | 2 056 626 | A1 | 5/2009 |
| EP | 2056626 | A1 * | 5/2009 |
| GB | 2 296 973 | A | 7/1996 |
| WO | WO 2010/073749 | A1 | 7/2010 |

* cited by examiner

*Primary Examiner* — Curtis Kuntz
*Assistant Examiner* — Sunita Joshi
(74) *Attorney, Agent, or Firm* — Birch, Stewart, Kolasch & Birch, LLP

(57) ABSTRACT

The disclosure describes a hearing aid part, a detection device for finding the hearing aid part when lost, and a hearing aid system comprising a hearing aid part and a detection device. The hearing aid part comprises, a control unit and an antenna circuit that are part of a wireless unit for wireless transmission and/or reception of electromagnetic signals. The antenna circuit comprises a capacitance and an inductance that together define a resonance frequency of the antenna circuit. The hearing aid part further comprises a dissipative resistance and a switch. The dissipative resistance and the switch are arranged to allow selective coupling or decoupling of the dissipative resistance to or from, respectively, the antenna circuit to thus allow controlling of the dissipative properties of the antenna circuit by the switch.

20 Claims, 4 Drawing Sheets

HEARING AID AND DETECTION DEVICE

Figure 1A:
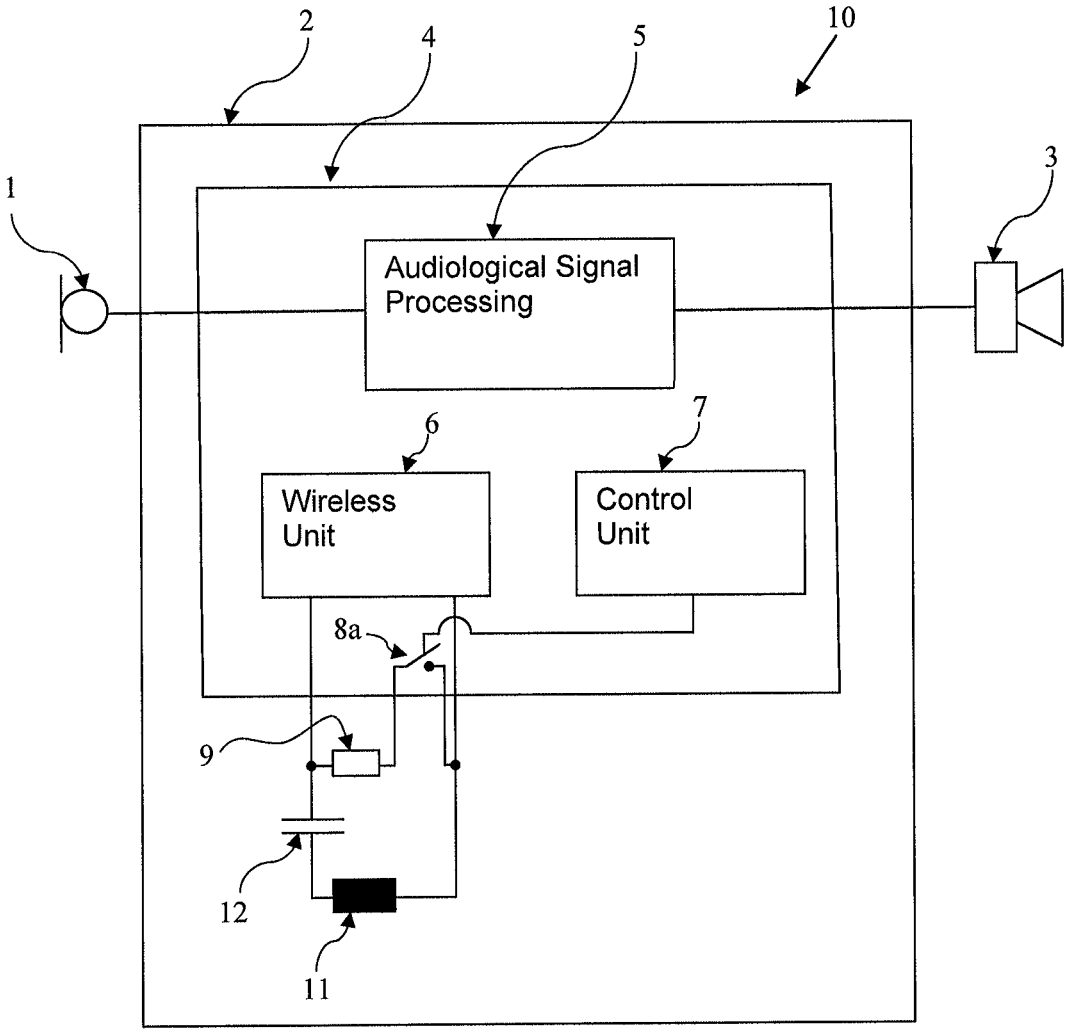

CROSS REFERENCE TO RELATED APPLICATIONS:

This nonprovisional application claims the benefit of U.S. Provisional Application No. 61/609,962 filed on Mar.13, 2012 and to patent application Ser. No. 12159221.6 filed in the European Patent Office, on Mar. 13, 2012. The entire contents of all of the above applications are hereby incorporated by reference.

The present disclosure refers to a hearing aid (or a part of a hearing aid) and a detection device for same.

Hearing aids are small user-worn devices that can aid the user with listening to spoken language or other sound. To improve the perception of sound by a user, a hearing aid comprises at least one microphone for receiving acoustic sound signals and converting acoustic signals into electrical signals (or other input transducer for receiving electric signals comprising audio). These electrical signals are processed and, if necessary, amplified. The processed and amplified electrical signal is fed to a loudspeaker and converted into a sound signal that is directed to a user's ear. The loudspeaker of a hearing aid is commonly called a "receiver", although it is not a receiver in the otherwise common sense of the word (in the present context of hearing aids, the term "receiver" is used in the same way as traditionally used in the field of telephones to mean an earphone that converts electrical signals into (acoustic) sounds (i.e. a loudspeaker)). Modern hearing aids can be remote-controllable and may comprise a wireless unit for wireless data exchange with other devices or units.

A wireless unit is usually connected to an antenna circuit to transmit and/or receive electromagnetic signals generated by or received by the wireless unit. Further, a control unit may be provided to control the operation of the hearing aid, e.g. if the hearing aid is switched on or off or if volume or other settings are altered. For these purposes, the control unit may be operatively connected to both an audiological signal processing unit and to the wireless unit. However, a more basic control unit that only serves for controlling switching on and off of the hearing aid may lack such operative connection to the wireless unit and/or the audiological signal processing unit. The term "audiological signal processing unit" is intended to indicate that the unit includes processing of signals relating to a user's perception of an input audio signal, e.g. enhancing a signal picked up by an input transducer of the hearing aid, with a view to the user's hearing impairment (e.g. including applying a time and frequency dependent gain to the signal).

Conventional air-conduction hearing instruments or other listening devices or parts thereof are normally (portable or wearable) small items of physical dimensions not larger than a few centimeters, typically comprising a source of energy (e.g. a rechargeable energy source, e.g. a battery). While such devices are not worn continuously day and night, they are put on and off several times per day. It may happen that the user has forgotten where the hearing aid was put off and placed afterwards, so that the hearing aid cannot be immediately found.

Due to its small size, it can easily be covered by other items in an ordinary household. In such case, it may become difficult and time-consuming to find the hearing aid or a part of a hearing aid.

The main task of a conventional air-conduction hearing aid is to amplify sound. If not in place at the ear, acoustic feedback may result. A consequence of acoustic feedback in hearing aids may be an audible whistling of the hearing aid. This may help normally hearing people to localize the hearing aid. Due to the handicap, it is very often not possible for a hearing impaired person to perceive the whistling of the hearing aid. Additionally, if the hearing aid has been left alone in "on-position" for a longer period of time, it may happen that the battery is drained completely and the hearing aid is not functioning. In this case, no whistling sound will be emitted that would otherwise help to find the hearing aid. Other portable, battery driven electronic parts may have similar localization problems. Other hearing aids than conventional air-conduction hearing aids may benefit from the present invention, e.g. bone conduction hearing aids or cochlear implant hearing aids, the latter comprising e.g. a part adapted for being located behind an ear, and external and implanted co-axially located antenna parts and an implanted electrode part.

EP2056626A1 describes a hearing aid system having a wireless communication unit for inductively transmitting and receiving signals. The wireless communication unit comprises a data stream input unit, an active unit, a frequency determining unit, an inductive antenna and a receiver front end. The frequency determining unit may comprise an inductor, two capacitances and, and a resistor. The resistor may be connected in series with another resistor, which may be bypassed by an activating switch. This may be implemented in order to achieve a fast initiation and termination of oscillations.

It is an object of the present disclosure to provide means that aid a user when searching for her or his hearing aid or a part of the hearing aid.

A hearing aid device may comprise a number of separate parts which is or can be brought in (wired or wireless electrical and/or or acoustic) communication with each other during operation of the device. Such separate parts can be a first part e.g. adapted to be located behind the ear of a user and a second part e.g. adapted to be located at or in the ear of the user, the two parts being in electric and/or acoustic and/or electromagnetic communication with each other. The present inventive idea can be used in connection with such hearing aid or part of a hearing aid that comprises a control unit and a wireless unit comprising an antenna circuit. The presence of other functional components of the hearing aid, such as transducer and signal processing units in the part that is to be found, is not essential.

In a more general perspective, the inventive idea can be used in connection with any portable (small) electronic device comprising control unit and a wireless unit comprising an antenna circuit (e.g. a headset, an electronic key, an ear phone, etc.) and a corresponding detection device. In the present context, the term 'small' is taken to mean having a maximum outer dimension less than 0.1 m, such as less than 0.05 m, such as less than 0.02 m.

According to the present disclosure, the object is achieved by a hearing aid part comprising a control unit and an antenna circuit that is part of a wireless unit for wireless transmission and/or reception of electromagnetic signals. The antenna circuit comprises a number of electronic components (e.g. comprising a capacitance and/or an inductance) that together define a resonance frequency of the antenna circuit. The hearing aid part further comprises a dissipative resistance and a switch. The dissipative resistance and the switch are arranged to allow selective coupling or decoupling of the dissipative resistance to or from, respectively, the antenna circuit to thus allow controlling of the dissipative properties of the antenna circuit by means of the switch. If the dissipative resistance is coupled with or connected to the antenna circuit, it dissipates some of the energy of the antenna circuit. If the dissipative resistance is decoupled or disconnected from the antenna circuit, the dissipative resistance is ineffective. The switch allows for selective coupling or decoupling of the resistance to the antenna circuit.

In an embodiment, the hearing aid part further comprises an input transducer (e.g. a microphone and/or a wireless receiver). In an embodiment, the hearing aid part comprises an audiological signal processing unit. In an embodiment, the hearing aid part comprises an output transducer (e.g. a receiver, also termed loudspeaker). In an embodiment, the hearing aid part comprises an input transducer, an audiological signal processing unit, and an output transducer (which form part of or constitute a forward path of the hearing aid part). The input transducer and the output transducer are operatively connected to the audiological signal processing unit that is configured to process a sound-representing electrical signal provided by the input transducer and to generate an output signal that can be transformed into sound (or a stimulus perceivable by the user as sound) by means of the output transducer. In an embodiment, the hearing aid part constitutes a hearing aid in itself.

In an embodiment, the hearing aid part comprises a local source of energy, e.g. a battery, such as a rechargeable energy source. In an embodiment, the hearing aid part comprises circuitry for extracting energy from a signal received by the wireless unit to energize components of the hearing aid part.

The dissipative resistance preferably is or comprises an Ohmic resistor. In an embodiment, the switch comprises a transistor.

In an embodiment, the wireless unit and the antenna circuit defines an interface for establishing a wireless link to another device (e.g. a remote control, another hearing aid part or hearing aid (e.g. a contra-lateral hearing aid of a binaural hearing aid system), an audio gateway, etc.). In a preferred embodiment, the wireless link is a link based on near-field communication, e.g. an inductive link based on an inductive coupling between antenna coils of transmitting and receiving parts. In such case, an inductance of the antenna resonance circuit of the hearing aid part according to the present disclosure may form part of or constitute the mentioned antenna coil of the hearing aid part. The same may correspondingly be the case of a capacitance, if the wireless link is based on a capacitive coupling. In another embodiment, the wireless link is based on far-field, electromagnetic radiation. Again, the electronic components of the antenna circuit may contribute to establishing the wireless interface to other devices.

In an embodiment, the wireless link to another device is in the base band (audio frequency range, e.g. between 0 and 20 kHz). Preferably, however, the wireless link is based on some sort of modulation (analogue or digital) at frequencies above 100 kHz. Preferably, frequencies used to establish communication between the hearing aid or hearing aid part and the other device is below 50 GHz, e.g. located in a range from 5 MHz to 50 GHz, e.g. below 100 MHz. In an embodiment, the wireless link is based on frequencies above 100 MHz, e.g. in an ISM range above 300 MHz, e.g. in the 900 MHz range or in the 2.4 GHz range or in the 5.8 GHz range.

In an embodiment, the resonance frequency of the antenna circuit of the hearing aid part is adapted to the frequency range of the wireless link for establishing communication to and/or from another device or part.

In a preferred embodiment, the switch is connected to and controlled by the control unit and the control unit is configured to couple the dissipative resistance with the antenna circuit when the audiological signal processing unit and/or the hearing aid part is switched off, and/or if the internal power supply of the hearing aid part is below a threshold (e.g. in that a voltage of a battery is below a threshold voltage, e.g. 1.2 V) or drained completely.

By means of the dissipative circuit, a hearing aid part is supplied with means that help finding the hearing aid part when lost, even if it is switched off or if the internal power supply of the hearing aid part is drained completely.

Preferably, the antenna circuit is connected to a wireless unit that is connected to and controlled by said control unit. In an embodiment, the wireless unit serves for data and signal communication to and from the hearing aid part, when the hearing aid part is operating.

In a preferred embodiment of the hearing aid part, the control unit is connected to the audiological signal processing unit and is adapted for controlling (at least a part of) the audiological signal processing unit. This allows e.g. a user (or an automatic procedure) to select a hearing situation and to adapt the audiological signal processing unit to a selected hearing situation.

In an embodiment, the audiological signal processing unit form part of an integrated circuit (IC). In a further preferred embodiment of the hearing aid part, the control unit, the audiological signal processing unit and (optionally all or a part of) the wireless unit are implemented into an integrated circuit. The switch may be implemented into said integrated circuit, too, or the switch is a non-integrated part of an electronic block of the hearing aid part that also comprises the integrated circuit.

The object is further achieved by a detection device for such hearing aid or hearing aid part. The detection device comprises an emitting circuit that is configured to generate and emit an electromagnetic signal that is tuned or tunable to a resonance frequency of the hearing aid part as disclosed above. The emitting circuit is connected to a detection device antenna. The detection device further comprises an impedance metering unit that is operatively connected to the detection device antenna and that is configured to determine a measure of an impedance of the detection device antenna when the emitting circuit emits an electromagnetic signal. The detection device further comprises an impedance evaluation unit that is connected to the impedance metering unit and that is configured to evaluate a current impedance value (e.g. with respect to a reference value).

Such detection device can act as a hearing aid part finder for a hearing aid part having an antenna circuit with a dissipative resistance, because an electromagnetic signal emitted by the detection device is in part dissipated by the dissipative antenna circuit of the hearing aid part when the hearing aid part is in the range of the detection device. The dissipation of the electromagnetic signal in the hearing aid part antenna circuit results in a change of impedance of the detection device antenna circuit. This change of impedance can be detected and indicated by the detection device. If the detection device generates a user-perceivable signal that is generated in response to a detected change of impedance, the user is informed that the hearing aid part is in the range of the detection device.

In a preferred embodiment of the detection device, the detection device is designed to indicate (e.g. show) the distance to the lost hearing aid part. The hearing aid part utilizes components already available with the wireless functionality of state-of-the-art hearing aids or hearing aid parts. Few extra components need to be added to the antenna circuit to enable the hearing aid part to be found by a dedicated detection device.

With respect to the detection device, it is preferred that a reference value for the evaluation of a current impedance signal by the impedance evaluation unit reflects an impedance measured by the impedance metering circuit when no hearing aid part is in the range of the detection device. The impedance evaluation is preferably configured to compare the reference value with the current impedance value and to generate a user-perceivable signal that indicates a difference between said current impedance value and said reference value. Preferably, the user-perceivable signal is a signal that indicates a magnitude of a difference between the reference value and the current impedance value. Thus, it is possible that the user-perceivable signal is generated in such a way that the user perceivable signal indicates a distance to a hearing aid part. This can be achieved if the range of possible differences in magnitude between a current impedance value and the reference value is mapped to a distance scale (and e.g. stored in a memory of the detection device prior to its use). A number N of predefined corresponding values of a measured detection unit antenna impedance $Z_{DDAi}$ and distance $x_i$ (i=1, 2, . . . , N) to the hearing aid part in question may be obtained by measurement in advance of ordinary use of the hearing aid part (e.g. at a fitting session or during fabrication test) and stored in a memory of the detection device. Preferably, the impedance evaluation unit is configured to be able to interpolate between two values of antenna impedance to provide a distance $x_{cur}$ between $x_n$ and $x_{n+1}$ corresponding to a measured antenna impedance $Z_{DDACUr}$ between $Z_{DDAn}$ and $Z_{DDAn+1}$.

In a preferred embodiment, the user-perceivable signal is a visual signal, e.g. on a display, that shows the distance to the hearing aid part. Alternatively or additionally, the user-perceivable signal may be aimed at other senses of the user; it may e.g. include an audible signal and/or a vibrational signal, and/or a temperature variation signal (a higher temperature indicating e.g. a smaller distance).

The detection device can be a standalone (preferably portable) device or it can be implemented into a hearing aid remote control and/or into an audio gateway device. In an embodiment, the detection device form part of a communication device, e.g. a Smartphone.

A hearing aid finder system thus comprises at least two parts, the hearing aid or hearing aid part to be found and a detecting device.

In an aspect, a hearing aid system comprising a hearing aid part and a detection device is thus provided.

The hearing aid part comprises a wireless unit, a control unit, and an antenna circuit as part of or connected to said wireless unit, said antenna circuit comprising a capacitance and an inductance that define a resonance frequency of said antenna circuit, and a dissipative resistance, and a switch, wherein the dissipative resistance and the switch are arranged to allow selective coupling of the dissipative resistance with or disconnecting the resistance from the antenna circuit, respectively, to thus allow control of the dissipative properties of the antenna circuit by means of the switch.

The detection device comprises an emitting circuit, and a detection device antenna said emitting circuit being configured to generate and emit an electromagnetic signal that is tuned or tunable to said resonance frequency of said antenna circuit of said hearing aid part, said emitting circuit being connected to said detection device antenna, an impedance metering unit, and an impedance evaluation unit, wherein the impedance metering unit is configured to determine a measure of an impedance of the detection device antenna when the emitting circuit emits an electromagnetic signal and said impedance evaluation unit is connected to the impedance metering unit and is configured to evaluate a current impedance value with respect to a reference value.

In an embodiment, the hearing aid part further comprises an input transducer, an audiological signal processing unit, and an output transducer, the input transducer and the output transducer being operatively connected to the audiological signal processing unit, the audiological signal processing unit being configured to process a sound representing an electrical signal provided by the input transducer and to generate an output signal that can be transformed into a stimuli perceived as sound by a user by means of the output transducer.

In an embodiment, the switch is connected to and controlled by the control unit, and the control unit is configured to couple the dissipative resistance with the antenna circuit when the audiological signal processing unit and/or the hearing aid or hearing aid part is switched off, and/or if the internal power supply of the hearing aid or hearing aid part is below a threshold or drained completely.

In a preferred embodiment, the detection device forms part of a remote control for controlling or influencing functions of the hearing aid (e.g. its volume, the current program for processing an input signal to the hearing aid, a power-on or power-off, etc.). In an embodiment, the hearing aid system comprises a pair of hearing aids or hearing aid parts forming part of a binaural hearing aid system. Preferably, both of the hearing aids or hearing aid parts are hearing aids or hearing aid parts as described above and in connection with the drawings and in the claims, so that the detection device is adapted to provide a distance measure for any of the two hearing aid devices (possibly being able to differentiate between the two).

In an embodiment, the detection device is configured to detect whether the hearing aid (or one or both hearing aids of a binaural hearing aid system) is in an activated (power on) or in a deactivated (power off or low power) state. In an embodiment, the detection device is configured to activate (power on) or deactivate (power off or low power) the hearing aid (part) (or hearing aids) according to a predefined scheme. In an embodiment, the detection device is configured to transmit information on the detected status of the hearing aid (or hearing aids) to another device, e.g. to a programming device or a control device (e.g. in the form of a communication device, e.g. a Smartphone). The mentioned interaction between the detection device and a hearing aid may be implemented between a detection device and a hearing aid part.

In an embodiment, the output transducer of the hearing aid comprises a receiver or loudspeaker for converting an electric signal to an output sound for being perceived by a user wearing the hearing aid. In an embodiment, the hearing aid comprises a bone-anchored hearing aid. In such case the output transducer of the hearing aid comprises a mechanical vibrator converting an electric signal to a vibration of bones of the head of a user wearing the hearing aid. In an embodiment, the output transducer of the hearing aid comprises a multi-array electrode of a cochlear implant.

Figure 1B:
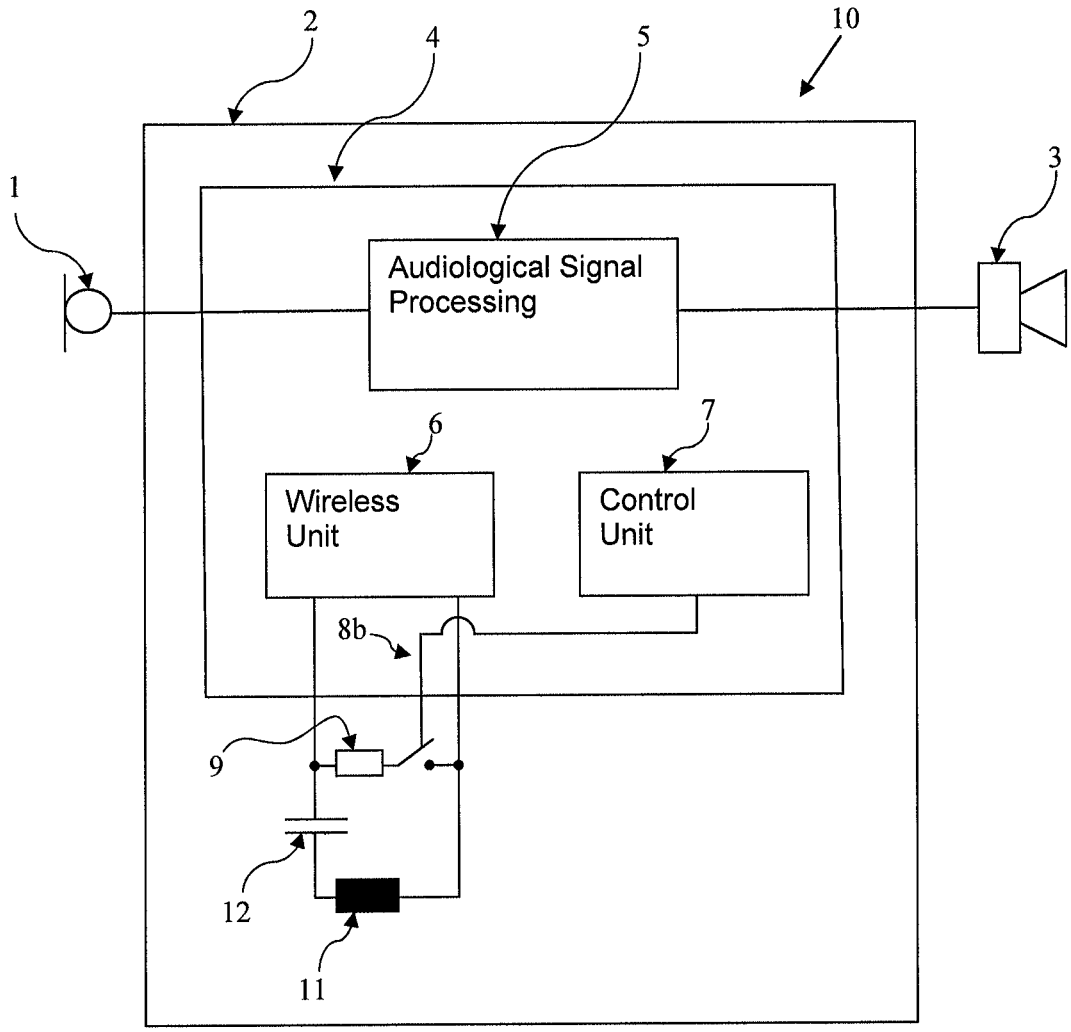
Figure 2:
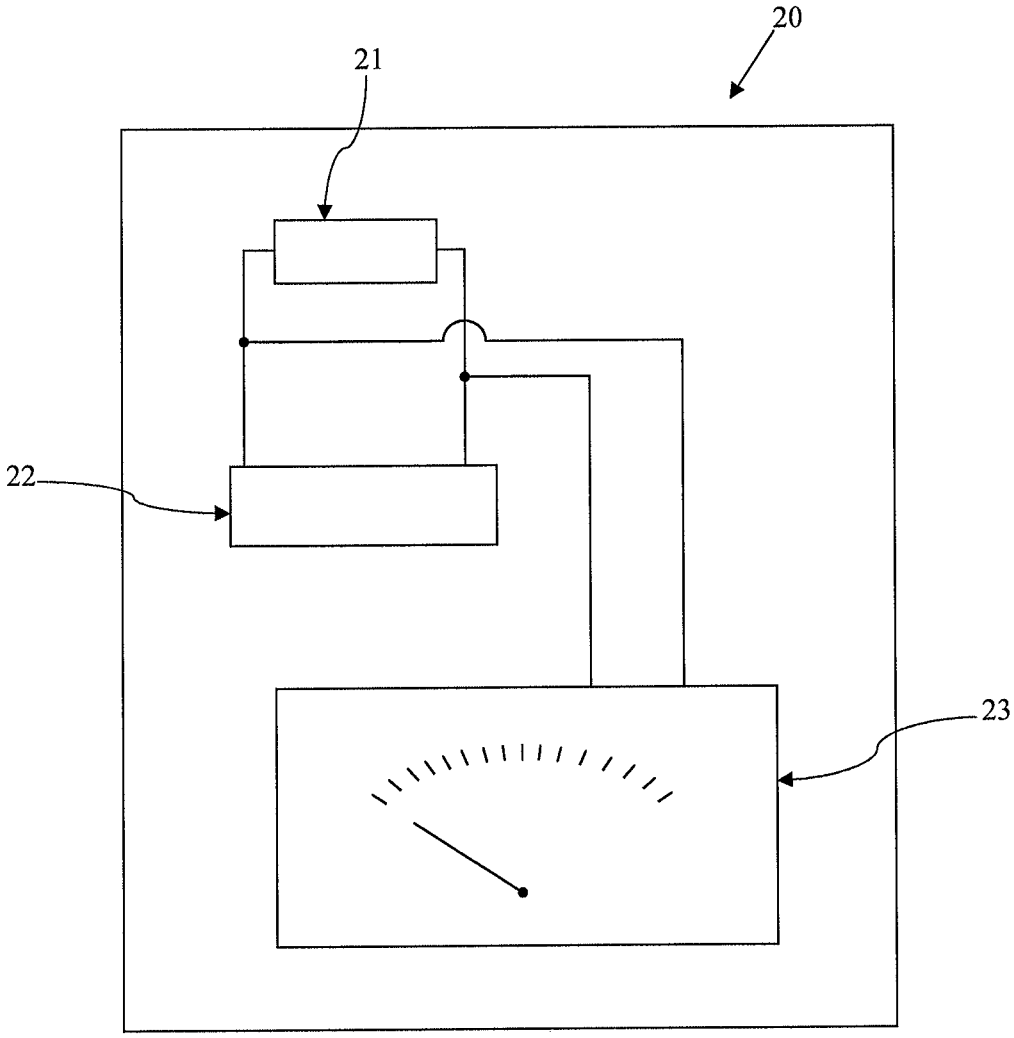
Figure 3A:
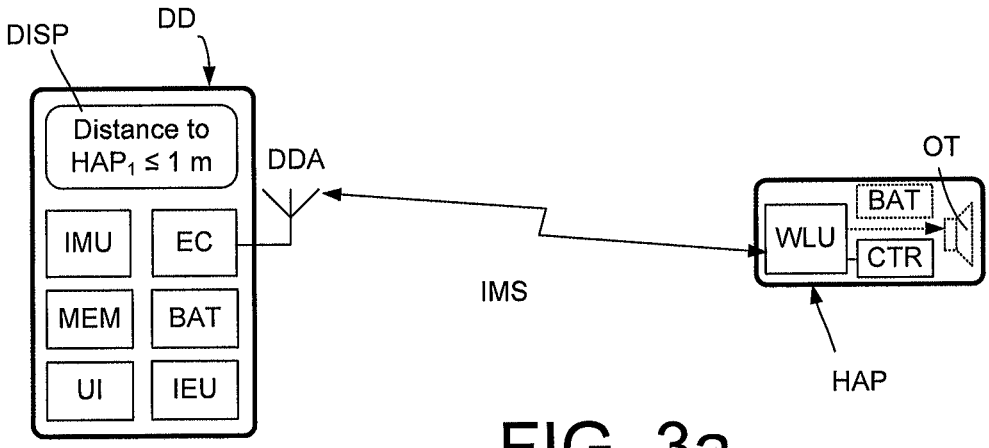
Figure 3B:
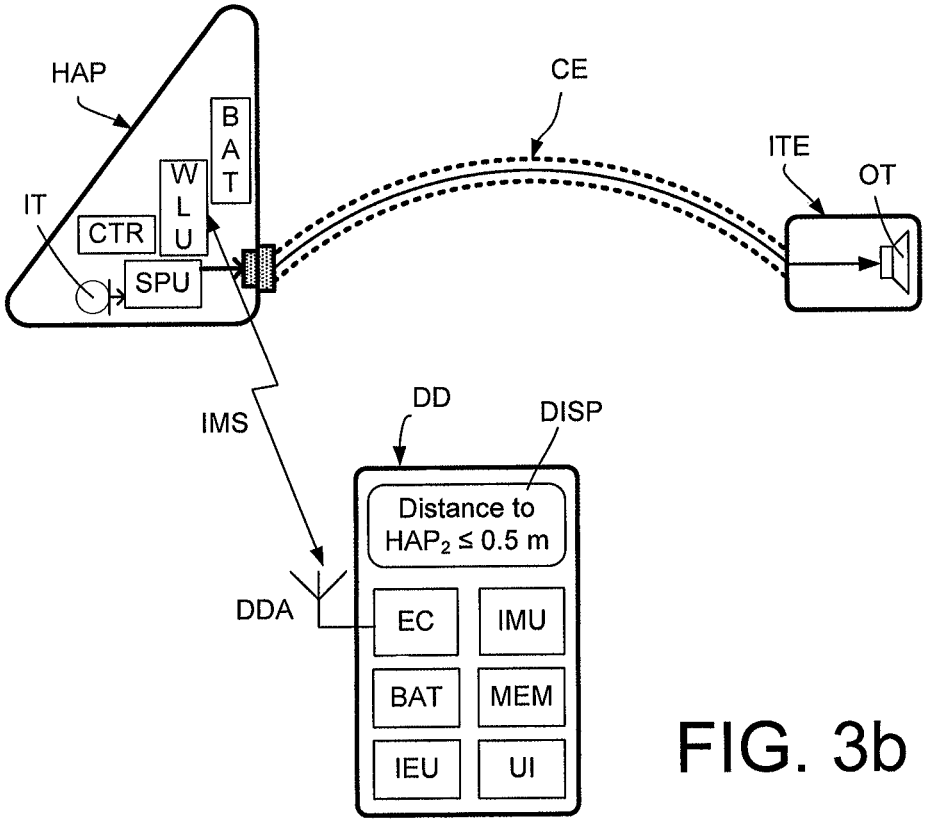

The present disclosure shall now be further illustrated by way of example with reference to the attached figures. Of these figures:

FIGS. 1*a* and 1*b* show alternative embodiments of a hearing aid according to the present disclosure, FIG. 2 shows an embodiment of a detection device according to the present disclosure, and FIGS. 3*a* and 3*b* show alternative use cases of a hearing aid system according to the present disclosure.

The figures are schematic and simplified for clarity, and they just show details which are essential to the understanding of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

An embodiment of a hearing aid 10 that can be found by means of a detection device 20 (cf. FIG. 2) is shown in FIG. 1*a* and FIG. 1*b*. The hearing aid 10 comprises the following parts: One or multiple input transducers (e.g. microphones) 1, an electronic block 2, and one or multiple output transducers (e.g. receivers) 3. The hearing aid 10 may alternatively or additionally comprise a wireless receiver for receiving an electric signal comprising control and/or audio signals (and possibly a selection or mixing unit allowing a selection of one of the input signals comprising audio or a mixing of such input signals from the input transducers). The output transducer may e.g. comprise a mechanical vibrator, e.g. associated with a bone-anchored hearing aid.

The electronic block 2 comprises at least an integrated circuit (IC) 4 and a tuned antenna circuit comprising a dissipative resistance 9, a capacitance 12 and an inductance 11. In an embodiment, one or more of the dissipative resistance 9, the capacitance 12 and an inductance 11 may be included in the integrated circuit in part or in full (e.g. some of the capacitance 12 may be included in the IC and some of it may external). The electronic block may comprise further ICs, possibly partitioned in other ways than shown in FIG. 1*a* or 1*b*.

The integrated circuit comprises an audiological signal processing unit 5 for the audiological signal processing and a wireless unit 6. During the intended use of the hearing aid, the wireless unit 6 receives and sends control information and/or audio data (e.g. from another hearing aid and/or from a remote control and/or an audio gateway). The information is transferred via electromagnetic waves of a determined frequency or frequency range. The electromagnetic waves are sent and received via a tuned antenna. For this regular mode of operation, the antenna comprises the capacitance 12 and the inductance 11.

For the particular purpose of the invention, two further components, which are not required for the intended use as a hearing aid, are added to the hearing aid circuit: The resistance 9 and a switch 8*a* in FIG. 1*a* or a switch 8*b* in FIG. 1*b*, respectively. The regular use of the hearing aid does not require the resistance 9, which in general would increase the loss of the antenna circuit having an adverse effect on the intended use. For this reason, the resistance 9 can be deactivated or activated by the switch 8*a* in FIG. 1*a* or by the switch 8*b* in FIG. 1*b*. The difference between the embodiments of FIG. 1*a* and FIG. 1*b* is the implementation of the switch either within the integrated circuit 4 as shown in FIG. 1*a* or as a separate component on the electronic block 2 as shown in FIG. 1*b*.

The switch 8 is operated (controlled) by the control unit 7. During regular use, when the hearing aid 10 is worn at a user's ear, the switch 8 is open and the resistance 9 is not active as long as the hearing aid is switched on and normal operation as intended. The switch 8 closes and the resistance 9 is active if the hearing aid is switched off or if the battery is drained.

The detection device 20 is shown in FIG. 2. The detection device comprises at least an emitting circuit 22 generating an electromagnetic signal of a certain frequency and emitting it via an antenna 21. The frequency of the emitting circuit 22 is tuned to match the resonance frequency of the antenna circuit of the hearing aid. The detection device 20 further comprises an impedance metering unit 23 that is configured to measure the impedance of the antenna 21.

If the hearing aid 10 with the receiving antenna is located far from the detection device (i.e. "out of range", e.g. more than 5 m or more than 10 m or more than 20 m), or otherwise electromagnetically shielded from the electromagnetic signal of the detection device, the impedance metering unit 23 will measure the impedance of the antenna of the detecting device alone. If the detection device 20 is brought in close proximity to the receiving antenna of the hearing aid (e.g. within a distance of 20 m or 10 m or 5 m or 2 m), the antenna of the hearing aid will be coupled inductively to the antenna of the detection device 20 and, thus, change its impedance.

To detect this change, the impedance metering unit 23 comprises an impedance evaluation unit. In its most simple embodiment, the impedance evaluation unit is a calibrated scale as shown in FIG. 2. The calibrated scale is configured to indicate to a user a proximity to the hearing aid with an "out of range" mark on the scale. The "out of range" mark marks the position of the needle when the hearing aid is out of range. The bigger the deflection of the needle from the "out of range" position is, the closer is the hearing aid, because the coupling of the antenna of the hearing aid to the antenna of the detection device and, therefore, the total impedance of the antenna of the detection device, is dependent from the distance between the two devices. The value shown by the impedance metering unit 23 and the impedance evaluation unit, respectively, can be interpreted as an indication of the distance between the hearing aid to be found and the detector device.

Instead of an impedance metering unit with an evaluation unit, which is a scale with needle that acts as a visual signal indicating display, any form of display can be used, e.g. a numerical or a graphical display or a combination thereof.

The latter embodiment is particularly useful if the detection device is implemented as an integral part of a remote control for wirelessly controlling the hearing aid. In an embodiment, the detection device is implemented in a communication device, e.g. a Smartphone. Alternatively or additionally, information captured by the detection device is displayed and/or further processed in a smart phone.

FIGS. 3*a* and 3*b* show alternative use cases of a hearing aid system according to the present disclosure.

FIG. 3*a* shows a first embodiment of a hearing aid part (HAP) and an embodiment of a detection device (DD). The hearing aid part (HAP) comprises a wireless unit (WLU) and a control unit (CTR). The wireless unit (WLU) comprises an antenna circuit comprising a capacitance and an inductance that together define a resonance frequency, as e.g. described in connection with FIG. 1*a* and 1*b*. The wireless unit may e.g. be configured to establish a wireless interface to another device, e.g. to an implanted part of a cochlear implant hearing aid device or to another (external) body worn part of a hearing aid device (e.g. a BTE part adapted to be located at or behind an ear of a user or to an audio delivery device, e.g. a cell phone, such as a Smartphone). The hearing aid part (HAP) may (optionally) as illustrated in dotted outline in FIG. 3*a* further comprise a battery (BAT) and an output transducer (OT), e.g. a receiver (or loudspeaker) as shown in FIG. 3*a*, the hearing aid part thereby e.g. constituting an ITE part of a conventional air-conduction hearing aid device, the ITE part being adapted for being located in a user's ear canal. In an embodiment, the hearing aid part (HAP) further comprises an input transducer and a processing unit and possible other functional elements to thereby constitute a fully functional hearing aid device (e.g. a hearing aid device adapted for being located fully in an ear canal of a user). The detection device (DD) comprises an emitting circuit (EC) and an antenna (DDA) connected to the emitting circuit, the emitting circuit (EC) being configured to generate and emit an electromagnetic signal (IMS) that is tuned or tunable to a resonance frequency of the wireless unit (WLU) of the hearing aid part (HAP). The detection device further comprises an impedance metering unit (IMU) and an impedance evaluation unit (IEU). The impedance metering unit (IMU) is configured to determine a measure of an impedance $Z_{DDA}$ of the detection device antenna (DDA) when the emitting circuit (EC) emits an electromagnetic signal (IMS) and said impedance evaluation unit (IEU) is connected to the impedance metering unit (IMU) and is configured to evaluate a current impedance value $Z_{DDA}$ with respect to a reference value $Z_{DDAref}$. In an embodiment, the reference value $Z_{DDAref}$ is a value of the detection device antenna (DDA) when no other (loading) antennas are within an operating distance $x_{op}$ of the detection device (DD). The operating distance $x_{op}$ is in general dependent on the application (available power, antenna efficiency, near-field, far-field transmission, etc.) In an embodiment operating distance $x_{op}$ is smaller than 10 m, e.g. smaller than 5 m. The detection device (DD) comprises a memory unit (MEM) connected to the impedance evaluation unit (IEU) wherein said reference value $Z_{DDAref}$ of the impedance of the detection device antenna (DDA) is stored. In an embodiment, the memory unit (MEM) comprises a number N of different impedance reference values $Z_{DDAref1}$, $Z_{DDAref2}$, . . . , $Z_{DDArefN}$, each corresponding to an impedance of the detection device antenna (DDA), when a specific hearing aid part ($HAP_1$) is located a specific distance $x_1$, $x_2$, . . . , $x_N$ from the detection device (DD). Thereby a specific current distance can be estimated as the distance corresponding to the reference value closest to the currently measured value $Z_{DDA}$ (or preferably, a current estimated distance $x_{cur}$ is obtained by interpolation). In an embodiment, different hearing aid parts $HAP_1$, $HAP_2$, . . . , $HAP_Q$ (q=1, 2, . . . , Q, Q being larger than or equal to two) are configured to result in different impedance values $Z_{DDA1q}$, $Z_{DDA2q}$, . . . , $Z_{DDANq}$ of the detection device antenna (DDA), when impedance $Z_{DDA}$ of the detection device antenna (DD) is measured by the impedance metering unit (IMU) when a given hearing aid part $HAP_q$ is located at different distances from the detection device antenna (DD). Thereby, the detection device (DD) may differentiate between a number of hearing aid parts, e.g. two, e.g. a left and right hearing aid part ($HAP_L$ and $HAP_R$) of a binaural hearing aid system. The embodiment of a detection device (DD) shown in FIGS. 3*a* and 3*b* further comprises a local energy source (BAT), e.g. a battery (at least) for energizing the functional elements of the detection device (DD), and a display (DISP) for conveying information to a user (including information about a localization of a specific hearing aid part (e.g. $HAP_1$), e.g. an estimated distance, as illustrated in FIG. 3*a* by the text Distance to $HAP_1 \leq 1$ m). The detection device (DD) may further comprise a user operable interface (UI), e.g. in the form of a number of manually operable activation elements, e.g. a keyboard or a touch sensitive display, thereby allowing a user to activate an impedance measurement (and thus a search for the hearing aid part).

FIG. 3*b* shows a second embodiment of a hearing aid part (HAP) and an embodiment of a detection device (DD) as also illustrated in FIG. 3*a*. The hearing aid part (HAP) of FIG. 3*b* constitutes a BTE part (adapted for being located at or behind an ear of a user), which together with ITE part (ITE, adapted for being located at or in an ear canal of a user) and a detachable connecting element (CE) for electrically connecting the BTE and ITE parts constitute a conventional air conduction hearing aid device (e.g. of the RITE type, RITE=Receiver In The Ear). The hearing aid part (HAP) of FIG. 3*b* comprises a wireless unit (WLU) and a control unit (CTR) as described for the embodiment of FIG. 3*a*. The hearing aid part (HAP) further comprises a battery (BAT), e.g. a rechargeable battery, for energizing (at least) the functional elements of the hearing aid part (HAP). The hearing aid part (HAP) comprises an input transducer (IT), here a microphone unit, and a signal processing unit (SPU) for processing an input signal provided by the input transducer (IT) and propagating a processed signal to an output transducer (OT), e.g. a receiver (or loudspeaker) as shown in FIG. 3*b*. The output transducer is shown to be located in an ITE part, the ITE part being adapted for being located in a user's ear canal and e.g. constituting an ITE part of a conventional air-conduction hearing aid device. The hearing aid part (HAP) may comprise other functional elements than those shown in FIG. 3*b*. In a typical situation, the hearing aid part (HAP) is electrically connected to the ITE part (e.g. as illustrated via an electrical connector and electrical conductors in a cable of the connecting element CE) in case it is lost, so that the full hearing aid device is localized when the hearing aid part (HAP) is localized. Otherwise, only the hearing aid part (HAP) is localized by the detection device. In another embodiment, the hearing aid part further comprises an output transducer connected to the signal processing unit (SPU), and the ITE part (ITE) comprises a customized mould (but no output transducer), and the connecting element (CE) is constituted by an acoustic tube for conveying sound produced by the output transducer of the hearing aid part (HAP) to the mould for being presented at the user's ear drum. The detection device (DD) shown in FIG. 3*b* comprises the same elements as discussed in connection with FIG. 3*a*. In FIG. 3*b*, the hearing aid part (HAP) is identified by the detection device (DD) as $HAP_2$, cf. text information Distance to $HAP_1 \leq 0.5$ m in the display (DISP).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof. In the above part of the disclosure, the idea has been exemplified in connection with hearing aids, but it may be implemented in connection with any portable electronic devices comprising a wireless interface (e.g. head sets, ear phones, keys, etc.).

The invention claimed is:

1. A hearing aid part, comprising:

a control unit;

an antenna circuit as part of or connected to a wireless unit, said antenna circuit comprising a capacitance and an inductance that define a resonance frequency of said antenna circuit;

a dissipative resistance; and a switch, wherein the dissipative resistance and the switch are arranged to allow selective coupling of the dissipative resistance with or disconnecting the resistance from the antenna circuit, respectively, to thus allow control of the dissipative properties of the antenna circuit by switching the switch, the switch is connected to and controlled by said control unit, and said control unit is configured to control the switch to couple the dissipative resistance to the antenna circuit in response to the hearing aid part being powered off, and/or in response to an internal power supply of the hearing aid part being below a threshold or drained completely.

2. Hearing aid part according to claim 1, wherein the dissipative resistance comprises an Ohmic resistor.

3. Hearing aid part according to claim 1, wherein said antenna circuit is connected to the wireless unit that is connected to and controlled by said control unit.

4. Hearing aid part according to claim 1 comprising an input transducer for providing an electrical input signal representative of sound.

5. Hearing aid part according to claim 1 comprising an output transducer for converting an electric output signal to stimuli perceived by a user as sound.

6. Hearing aid part according to claim 1 comprising an audiological signal processing unit configured to process an electrical input signal representative of sound and to generate an electric output signal.

7. Hearing aid part according to claim 6, wherein said control unit is connected to said audiological signal processing unit and is adapted for controlling said audiological signal processing unit.

8. Hearing aid part according to claim 6, wherein said control unit is configured to couple the dissipative resistance with the antenna circuit when the audiological signal processing unit and/or the hearing aid is powered off.

9. Hearing aid part according to claim 1, wherein the wireless unit and the antenna circuit form part of an interface for establishing a wireless link to another device.

10. Hearing aid part according to claim 9 wherein the resonance frequency of the antenna circuit of the hearing aid part is adapted to the frequency range of the wireless link for establishing communication to and/or from another device.

11. Hearing aid part according to claim 9 wherein the wireless link is based on an inductive coupling between antenna coils of transmitting and receiving parts, and wherein an inductance of said antenna resonance circuit of the hearing aid part forms part of or constitute said antenna coil of the hearing aid part.

12. A hearing aid system, comprising:

a hearing aid part; and a detection device, the hearing aid part comprising a wireless unit, a control unit, and an antenna circuit as part of or connected to said wireless unit, said antenna circuit comprising a capacitance and an inductance that define a resonance frequency of said antenna circuit, and wherein the hearing aid part further comprises a dissipative resistance, and a switch, wherein the dissipative resistance and the switch are arranged to allow selective coupling of the dissipative resistance with or disconnecting the resistance from the antenna circuit, respectively, to thus allow control of the dissipative properties of the antenna circuit by means of the switch, the detection device comprising an emitting circuit, and a detection device antenna said emitting circuit being configured to generate and emit an electromagnetic signal that is tuned or tunable to said resonance frequency of said antenna circuit of said hearing aid part, said emitting circuit being connected to said detection device antenna, said detection device further comprising an impedance metering unit, and an impedance evaluation unit, wherein the impedance metering unit is configured to determine a measure of an impedance of the detection device antenna when the emitting circuit emits an electromagnetic signal and said impedance evaluation unit is connected to the impedance metering unit and is configured to evaluate a current impedance value with respect to a reference value.

13. The hearing aid system according to claim 12, wherein said reference value reflects an impedance measured by said impedance metering circuit when no hearing aid part is in the range of the detection device.

14. The hearing aid system according to claim 12, wherein the detection device is configured to generate a user-perceivable signal depending on a difference between said current impedance value and said reference value.

15. The hearing aid system according to claim 14, wherein said user-perceivable signal comprises a visual signal, a sound signal and/or or a vibration.

16. The hearing aid system according to claim 14, wherein the detection device is configured to generate and display said user-perceivable signal such that the user-perceivable signal indicates a distance to a hearing aid part.

17. The hearing aid system according to claim 12 wherein the detection device forms part of a remote control for controlling functions of the hearing aid or of a Smartphone.

18. The hearing aid system according to claim 12 wherein the detection device is configured to detect whether the hearing aid part or one or both hearing aid parts of a binaural hearing aid system is/are in an activated or in a deactivated state.

19. The hearing aid system according to claim 12 wherein the detection device is configured to activate or deactivate the hearing aid part or hearing aid parts according to a predefined scheme.

20. The hearing aid system according to claim 12 wherein the detection device is configured to transmit information on a detected status of the hearing aid part or hearing aid parts to another device.

* * * * *